US009869052B2

(12) United States Patent
Liang et al.

(10) Patent No.: US 9,869,052 B2
(45) Date of Patent: Jan. 16, 2018

(54) HEAT EXCHANGER FOR CONDENSATION IN CLOTHES DRYING AND CLOTHES DRYING SYSTEM AND CLOTHES DRYER AND DRYING METHOD THEREOF

(75) Inventors: Haishan Liang, Qingdao (CN); Peishi Lv, Qingdao (CN); Sheng Xu, Qingdao (CN); Huacheng Song, Qingdao (CN); Yonghong Xu, Qingdao (CN); Bin Song, Qingdao (CN)

(73) Assignees: HAIER GROUP CORPORATION, Qingdao, Shandong (CN); QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 675 days.

(21) Appl. No.: 14/355,607

(22) PCT Filed: Aug. 22, 2012

(86) PCT No.: PCT/CN2012/080441

§ 371 (c)(1),
(2), (4) Date: May 1, 2014

(87) PCT Pub. No.: WO2013/067837

PCT Pub. Date: May 16, 2013

(65) Prior Publication Data

US 2014/0298674 A1 Oct. 9, 2014

(30) Foreign Application Priority Data

Nov. 8, 2011 (CN) ..... 2011 1 0349942
Nov. 8, 2011 (CN) ..... 2011 1 0350840
Dec. 19, 2011 (CN) ..... 2011 1 0427039

(51) Int. Cl.
*D06F 58/24* (2006.01)
*D06F 58/22* (2006.01)
(Continued)

(52) U.S. Cl.
CPC ..... *D06F 58/24* (2013.01); *D06F 58/22* (2013.01); *F26B 21/086* (2013.01); *D06F 58/206* (2013.01)

(58) Field of Classification Search
CPC ..... D06F 58/22; D06F 58/24; D06F 58/206; F26B 21/086; F28G 3/16; F28G 3/163;
(Continued)

(56) References Cited

U.S. PATENT DOCUMENTS 6,648,067 B1 11/2003 Maute
7,055,262 B2 * 6/2006 Goldberg ..... D06F 58/206 34/108
(Continued)

FOREIGN PATENT DOCUMENTS

CN 2532098 Y 1/2003
CN 1936160 A 3/2007
(Continued)

OTHER PUBLICATIONS

Partial English Machine Translation EP 0982427: Accessed Sep. 2016.*
(Continued)

*Primary Examiner* — Jianying Atkisson
*Assistant Examiner* — Tavia Sullens
(74) *Attorney, Agent, or Firm* — Buchanan Ingersoll & Rooney PC

(57) ABSTRACT

An external air-cooled heat exchanger includes two air channels going towards different directions and not connecting with each other, a condensing wind channel and an external air channel. Each air channel has a plurality of air chambers that are alternately arranged so that between each two neighboring air chambers of the same air channel is an air chamber of the other air channel change to a period; A clothes dryer includes an air outlet connected to the heat
(Continued)

exchanger. The heat exchanger is connected to a water collection box, the water collection box is connected to an air inlet, a filter is arranged between the air outlet and the heat exchanger, and a drying fan and the heating unit are arranged between the water collection box and the air inlet.

14 Claims, 6 Drawing Sheets

(51) Int. Cl.
*F26B 21/08* (2006.01)
*D06F 58/20* (2006.01)

(58) Field of Classification Search
CPC . F28G 3/166; F28G 1/16; F28G 1/163; F28G 1/166; F28G 9/00; F28G 9/005
USPC ..... 34/73, 74, 75, 86; 165/95, DIG. 12; 62/303
See application file for complete search history.

(56) References Cited

U.S. PATENT DOCUMENTS

| | | | | |
|---|---|---|---|---|
| 7,458,171 | B1 * | 12/2008 | Lentz | D06F 58/22 34/75 |
| 8,182,612 | B2 * | 5/2012 | Grunert | D06F 58/24 134/22.18 |
| 2006/0277690 | A1 | 12/2006 | Pyo et al. | |
| 2010/0192398 | A1 * | 8/2010 | Ahn | D06F 58/24 34/79 |
| 2010/0200018 | A1 * | 8/2010 | Grunert | D06F 58/24 134/10 |

FOREIGN PATENT DOCUMENTS

| | | | | |
|---|---|---|---|---|
| CN | 101684610 | A | 3/2010 | |
| CN | 102505437 | A | 6/2012 | |
| CN | 102517857 | A | 6/2012 | |
| CN | 102517860 | A | 6/2012 | |
| DE | 3404569 | A1 * | 8/1985 | F28G 1/163 |
| DE | 37 38 031 | A1 | 5/1989 | |
| DE | 4212965 | A1 * | 10/1993 | D06F 58/24 |
| DE | 43 06 215 | A1 | 9/1994 | |
| DE | 10 2008 006 347 | A1 | 7/2009 | |
| EP | 0 982 427 | A1 | 3/2000 | |
| EP | 2 169 107 | A1 | 3/2010 | |
| GB | 2 375 812 | A | 11/2002 | |
| JP | 55-110200 | U | 8/1980 | |
| JP | 58-195595 | A | 11/1983 | |
| JP | 05-003998 | A | 1/1993 | |
| KR | 10-2004-0046460 | A | 6/2004 | |

OTHER PUBLICATIONS

Partial English Machine Translation DE 4212965: Accessed Sep. 2016.*
Partial English Machine Translation CN 2532098.*
Extended European Search Report dated Jun. 8, 2015, issued by the European Patent Office in the corresponding European Application No. 12847897.1. (8 pages).
Office Action dated Jun. 2, 2015, issued by the Japanese Patent Office in corresponding Japanese Patent Application No. 2014-540296. (4 pages).
International Search Report (PCT/ISA/210) dated Dec. 6, 2012, by the Chinese Patent Office as the International Searching Authority for International Application No. PCT/CN2012/080441.

* cited by examiner

HEAT EXCHANGER FOR CONDENSATION IN CLOTHES DRYING AND CLOTHES DRYING SYSTEM AND CLOTHES DRYER AND DRYING METHOD THEREOF

FIELD OF THE INVENTION

The invention relates to the clothes dry field, specifically, to a clothes dryer and clothes drying method, in particular, to an improved heat exchanger for condensation in clothes drying, a clothes drying system with the heat exchanger and a clothes dryer and clothes drying method thereof.

BACKGROUND OF THE INVENTION

In the clothes dryer mechanism used for clothes drying machine or laundry dryer, the apparatus for producing hot air almost adopts the way of heating air by heater. The existing electro-thermal clothes dryer usually takes the heating strip/pipe as the heat source. This kind of product has high energy consumption, long drying time and poor security. To reduce energy consumption, heat pump clothes dryer, which employs heat pump system, is developed. This kind of clothes dryer strengthens the cyclic utilization of heat, improves the utilization efficiency of heat and lowers the power consumption.

The heat pump type clothes dryer apparatus are provided with the following air circulation channels: the air heated by the condenser in heat pump circulation system is sent into the drying chamber filling with clothes, and the air after absorbing moisture of clothes is then sent back to the evaporator for desiccation, after that, the air is again heated by the condenser and sent to the drying chamber.

Although the energy consumption of the heat pump type clothes dryer has decreased, the drying speed is not improved, the time required for drying process is still long. It usually takes 2 to 3 hours to dry 7-8 Kg clothes. In order to remove the moisture of clothes in a short time, people have taken various ways to achieve this purpose. The way that the clothes dryer adopted is to elevate temperature, enhance the ventilation of surface, and increase the heat-exchange surface. Although these ways have been used, the energy consumption and drying time are still high in the drying process. And if it proceeds to drying clothes under the high temperature, the fabric can be damaged, and may be prone to wrinkle and shrink.

Chinese patent application No. 200610153406.9 discloses a clothes drying apparatus in which the heat pump generating the drying air circulating between the drying chamber and the heat pump achieves stable operation. The air heated by the heater in heat pump is sent into the bucket which serves as drying chamber, and then the air emitted from the bucket returns back to the heat pump through the filter unit, and sent to the heater after being dehumidified by the heat absorber as a result of forming an air circulation channels. The filter unit is provided with a lint flushing filter and pipelines communicating with air outlet and air inlet.

The drying circulatory system of the existing clothes dryer utilizes the condensing heat exchanger equipped with cold air as the cooling medium, which is applied to clothes dryer or washing-drying integral machine. There're two main patterns, the one is to utilize the outside cool air to convert the hot and humid air generated in drying process into hypothermal and low-humidity air and recycle it; the other one is to exchange the hot and humid air generated in drying process with the outside hypothermal and low-humidity air and exhaust it, and then send the preheated outside air after exchanging inside for recycling. These patterns have their disadvantages. As for the former one, a large amount of outside cooling air is needed, and a relatively large quality of heat is taken away, thus the air reentering in the drying circulation needs to be heated with much energy. While for the latter one, in the course of emitting the drying air, the moisture in the moist air cannot be condensed totally, and there's still plenty of moisture access to the environment and influence the comfort level of the environment.

For the clothes dryer or washing-drying integral machine that the cold air is served as the cooling medium, in the drying process, the drying fan drives the drying air to flow along with the drying route, heating strip/pipe starts to heat, the hot air enters into the washing tub/clothes drying tub, in which the temperature of the clothes and moisture rises. The moisture evaporates into water vapor and then enters into the condensing heat exchanger by lint flushing filter. The condensate fan drives the outside air to exchange heat with the internal air. Thus the internal hot and humid air cools down, the water vapor condenses into liquid water, and the hot and humid air transforms into dry and hypothermal air which then is sent to heat strip/pipe by drying fan for being heated and drying circularly clothes.

The aforesaid condensing heat exchanger is made of the sheet metals, which are formed the drying wind channels and interlaced condensing wind channels by welding procedure. Such processing technology of condenser is quite complicated and the condenser cannot be processed and manufactured according to washing machine structure arbitrarily, and it costs high.

In view of that, the present invention is hereby proposed.

SUMMARY OF THE INVENTION

The invention overcomes the deficiency of the prior arts, and provides a simple-structured and low-cost heat exchanger for condensation in clothes drying.

Meanwhile, the invention provides a clothes dryer with the heat exchanger.

The invention provides a clothes drying system with the heat exchanger. In the process of drying, the condensed dry air is preheated by the residual heat of the hot and humid air exchanging heat with clothes, and then is heated, so as to raise the clothes drying efficiency, save electric energy and time.

The invention also provides a clothes dryer with the clothes drying system.

Then the invention provides a drying method of the clothes dryer with the clothes drying system.

To solve the above mentioned technical problems, the basic technical scheme of the invention is: a heat exchanger for condensation in clothes drying, being an external air-cooled type heat exchanger, which comprises two groups of air channels with different directions and not communicating with each other, the groups of air channels being respectively a condensing air channel and an external air channel; each group of air channels being composed of a plurality of air chambers, the air chambers of two groups of air channels being arranged alternately in turn, and the space between each two neighboring air chambers of the same group of air channel being an air chamber of the other group of air channel.

A condensate fan is set on one end of the external air channel, and the other end is communicated to the outside; one end of the condensing air channel is a hot and humid air inlet, and the other end is a condensed air outlet.

A mechanism for flushing lint is arranged at one end of the hot and humid air inlet of the condensing air channel of the heat exchanger. The mechanism for flushing lint comprises a flushing valve connection communicating with the outside, a flushing passageway communicating with the flushing valve connection and being set annularly along the hot and humid air inlet, and a flushing mouth setting along the inside edge of the flushing passageway for flushing water towards the air chambers of the condensing air channel.

Several groups of the flushing mouth are set on the both sides of each air chamber corresponding to the flushing water passageway. The flushing mouth is not limited be set on the both sides of each air chamber. The number of the flushing mouth can be reduced, and the flushing mouth is set at intervals corresponding to each air chamber.

The heat exchanger is composed of plastic film with a thickness of 0.05 mm to 1.5 mm, and two neighboring air chambers are spaced by the plastic film wall.

Preferably, the thickness of the plastic film is in the range of 0.08 mm to 0.8 mm; more preferably, the thickness of the plastic film is in the range of 0.1 mm to 0.5 mm.

The projections of two groups of air channels are intersected.

Preferably, the external air channel is in the horizontal direction, and the condensing air channel is in the vertical direction. Preferably, the hot and humid air in condensing air channel flows from top to bottom.

A ventilation clearance of each air chamber of the heat exchanger is 1 mm to 20 mm.

Preferably, the ventilation clearance of the air chamber is 3 mm to 12 mm.

A clothes dryer with the heat exchanger for condensation in clothes drying of the invention, includes a clothes tub, an air outlet, a filter, a drying fan, a heating unit and an air inlet as well as a water collection box, in which, the air outlet is communicated with the heat exchanger, the heat exchanger is communicated with the water collection box, the water collection box is communicated with the air inlet, the filter is arranged between the air outlet and the heat exchanger, and the drying fan and the heating unit are arranged between the water collection box and the air inlet in turn.

The water collection box is communicated with the outside via a draining pump, and a water level inductive switch for controlling to turn on the draining pump is installed in the water collection box.

The filter is composed of at least one layer of filter net.

Further, at least one layer of filter net is dismountable.

A clothes drying system with the heat exchanger for condensation in clothes drying of the invention comprises the water collection box and a residual heat recovery device. Two groups of air channels are arranged in the residual heat recovery device, namely, a hot and humid air channel and a residual heat recovery air channel. Two groups of air channels form a heat exchange structure. The hot and humid air channel is communicated with the condensing air channel of the heat exchanger, the water collection box and the residual heat recovery air channel in turns via ventilating duct.

The water collection box comprises a box body and a top cover, the top cover is respectively provided with an inlet communicating with the condensing air channel of the heat exchanger and an outlet communicating with the residual heat recovery air channel of the residual heat recovery device. The draining pump is installed in the water collection box. A water level inductive switch for controlling to turn on and off the draining pump is installed in the water collection box.

The residual heat recovery device comprises a shell and a heat exchanger arranged inside the shell. The hot and humid air channel and the residual heat recovery air channel are arranged in the heat exchanger in the way of bidirectional cross convection. Corresponding to two groups of air channels, an inlet of the hot and humid air channel and an outlet of the residual heat recovery air channel are respectively arranged on the upper of the shell, and an outlet of the hot and humid air channel and an inlet of the residual heat recovery air channel are arranged on the lower of the shell.

The heat exchanger is composed of two groups of heat exchange fins, each group of heat exchange fins form a plurality of air channels along the same direction. The space between the neighboring air channels of the same group is an air channel of the other group. The air channels composed of two groups of heat exchange fins are set by interval, which forms the heat exchange structure with bidirectional cross convection.

A clothes dryer with the clothes drying system of the invention includes a clothes tub and a heating unit. The clothes tub is provided with an air inlet and an air outlet. The air outlet is communicated with the hot and humid air channel of the residual heat recovery device, and the residual heat recovery air channel of the residual heat recovery device is communicated with the air inlet. And the heating unit is arranged between the residual heat recovery air channel and the air inlet.

A filter is set between the air outlet and the hot and humid air channel, and the filter is composed of at least one layer of filter net. Preferably, at least one layer of filter net is dismountable.

A drying fan is set between the residual heat recovery air channel and the air inlet.

The drying method of the clothes dryer with the clothes drying system of the invention comprises: in drying, the hot and humid air obtained by the heat exchange of hot air in the clothes tub with clothes first running through the hot and humid air channel of the residual heat recovery device for preliminary exchanging heat with the residual recovery air channel, and running through the heat exchanger and the water collection box for fully condensing to get a dry air, then the dry air being preheated in the residual heat recovery air channel by exchanging heat with the hot and humid air channel of the residual heat recovery device, and finally the preliminarily preheated dry air is heated via the heating unit, and the heated dry air goes in the clothes tub to exchange heat with the clothes.

Compared with the prior art, the invention achieve the following effects by adopting the aforesaid technical scheme, Heat exchanger and drying system of this invention also applied to washing-drying integral machine. The heat exchanger is made of plastic film, a non-metallic material, with a thickness of 0.05~1.5 mm. Compared with metallic heat-exchanger, the exchanger of the invention has lower production cost while higher heat exchanger efficiency. Besides, plastic film, as the material of heat exchanger, is easier to be manufactured and assembled in accordance with the various dying power of clothes dryer or washing-drying integral machine. Moreover, clothes dryer or washing-drying integral machine with the heat exchanger is much lighter, which is more convenient and cost-saving for transportation.

Drying system and clothes dryer of the invention comprise the heat exchanger, the water collection box and the residual heat recovery device which comprises two air channels, namely, the hot and humid air channel and the residual heat recovery air channel. In the residual heat recovery air channel, air condensed through the heat exchanger precools the hot and humid air in the hot and humid air channel from the clothes tub of the clothes dryer. Meanwhile, it also get preheated while absorbing the heat, thus lowering the energy loss of heating the heater of the clothes dry to the drying temperature, enhancing the drying efficiency and saving power. In the meantime, precooling function of the residual heat recovery device can also reduce the flow of condensed air outside and the noise of condensate fan.

Combining with the drawings below, the embodiments further are described in detail.

EMBODIMENTS

Embodiment 1

Figure 1:
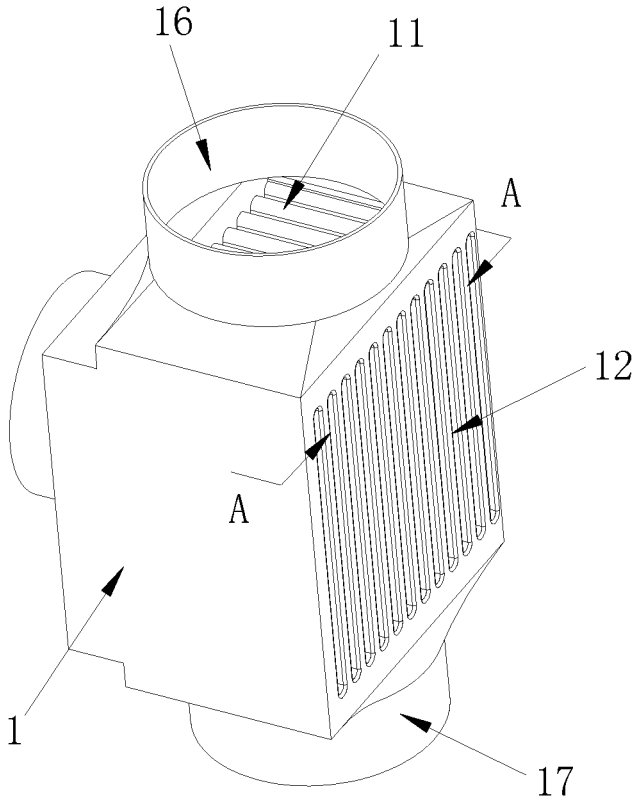
FIG. 1 is a schematic drawing of the heat exchanger of Embodiment 1 of the invention.
Figure 2:
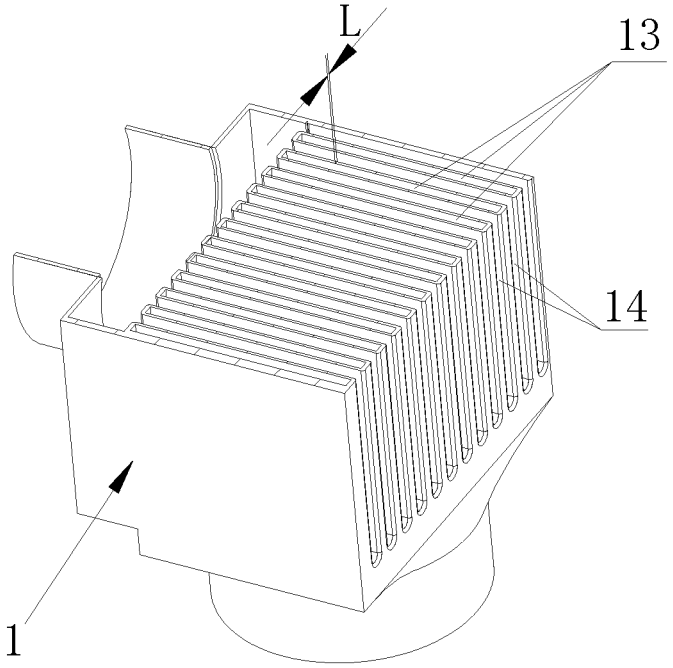
FIG. 2 is an A-direction sectional drawing of FIG. 1.

As shown in FIG. 1 and FIG. 2, the heat exchanger for condensation in clothes drying is installed in a clothes dryer or washing machine having the function of drying. The heat exchanger 1, made of plastic film, is an external air-cooled heat exchanger. The interior of the heat exchanger comprises two groups of air channels going towards different directions and not communicating with each other, which are respectively a condensing air channel 11 and an external air channel 12. Each group of air channel is composed of a plurality of air chambers. The air chambers of two groups of air channels are arranged alternately in turn. The space between neighboring air chambers of the same group of air channel is an air chamber of the other group of air channel, and all of them are made of interval plastic film walls.

A condensate fan 15 (see FIGS. 5 and 6) is set on one end of the external air channel 12, and the other end directly leads to the outside. The hot and humid air is put in through one end of the condensing air channel 11, and the condensed air and water are exhausted through the other end. The condensing air channel 11 is composed of air chambers 13. The external air channel 12 is composed of air chambers 14. The space between neighboring air chambers 13 of the condensing air channel 11 is an air chamber 14 of the external air channel 12. To prevent condensate water forming thermal resistance through sticking to the wall of air chamber and reducing the condensing efficiency, the hot and humid air in the condensing air channel 11 flow from top to bottom. Preferably, external air inside the external air channel 12 flow transversely.

wherein, the thickness L of the plastic film is in the range of 0.05 mm to 1.5 mm; preferably, the thickness of the plastic film is in the rang of 0.08 mm to 0.8 mm; more preferably, the thickness of the plastic film is in the rang of 0.1 mm to 0.5 mm. The embodiment adopts the plastic film with the thickness of 0.1 mm. The shape of the cross-section of the air chamber is not limited to rectangular, circle or elliptic type. Various corrugated shape for the drop of condensate water can also be set on the wall of the air chamber, or combination of the aforesaid shapes.

The plastic film of the present invention has heat resistance, for example, polyimide film, which is undistorted even at a temperature of 150□. The plastic film in the embodiment is polyethylene film with a distortion temperature of 80-100□.

Embodiment 2

Figure 3:
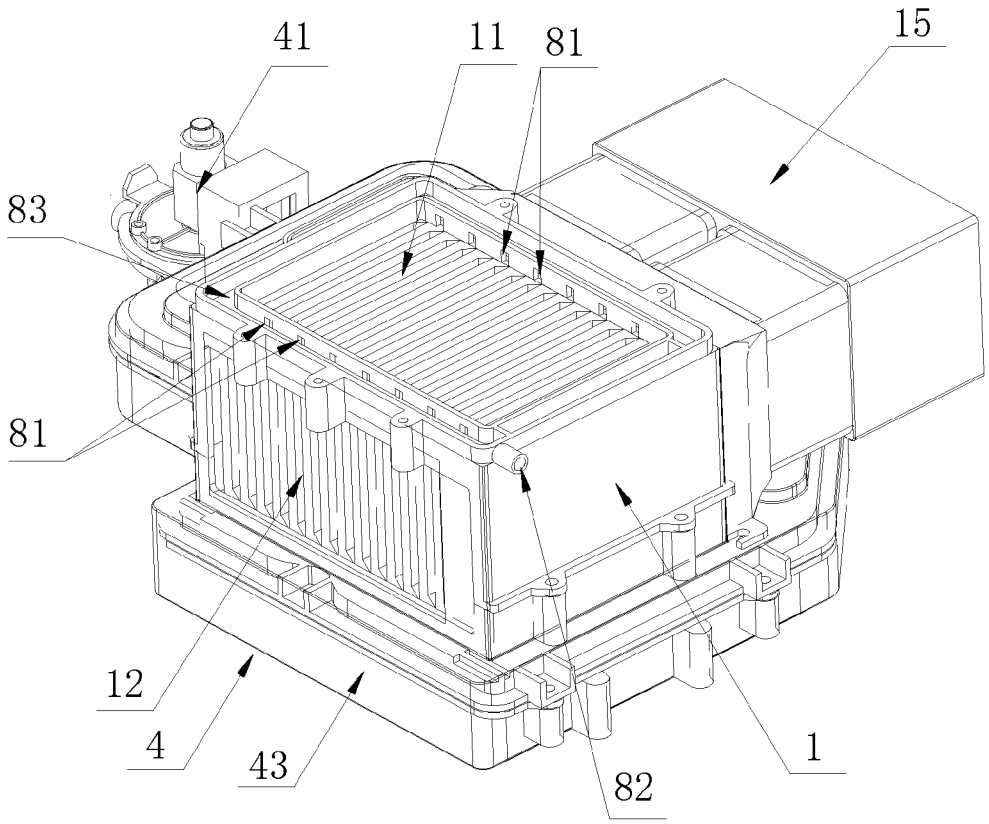
FIG. 3 is a schematic drawing of a mechanism for flushing lint of the invention in Embodiment 2.
Figure 4:
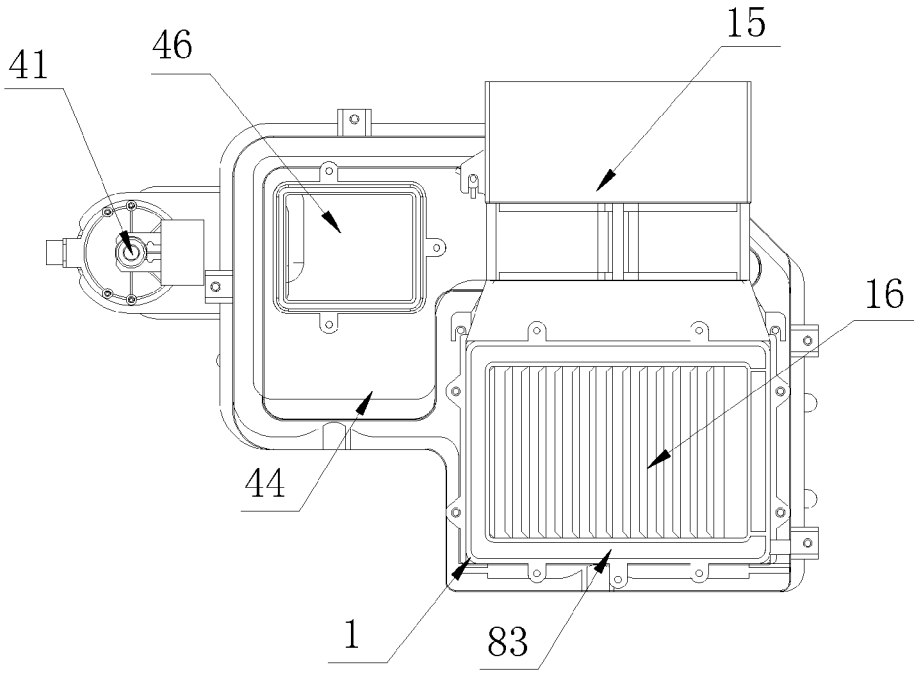
FIG. 4 is a schematic drawing of the heat exchanger of Embodiment 2 of the invention.

As shown in FIGS. 3 and 4, on the basis of Embodiment 1, a mechanism for flushing lint is comprised. The mechanism for flushing lint is arranged at one end of a hot and humid air inlet 16 of the condensing air channel 11 of the heat exchanger 1. The mechanism for flushing lint included a flushing valve connection 82 communicated with the exterior, a flushing passageway 83 communicating to the flushing valve connection and being set annularly along the air inlet for the hot and humid air of the heat exchanger, and a flushing mouth 81 set along the edge of the flushing passageway for flushing water towards the air channel for the hot and humid air in the inside of the heat exchanger.

Embodiment 3

Figure 5:
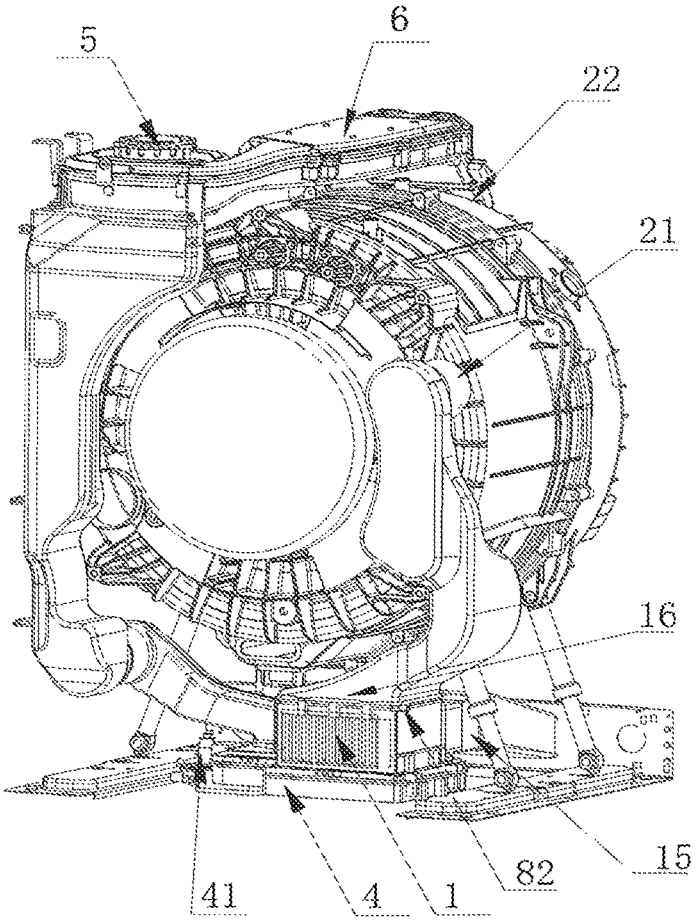
FIG. 5 is a schematic drawing of washing-drying integral machine of Embodiment 3 of the invention.
Figure 6:
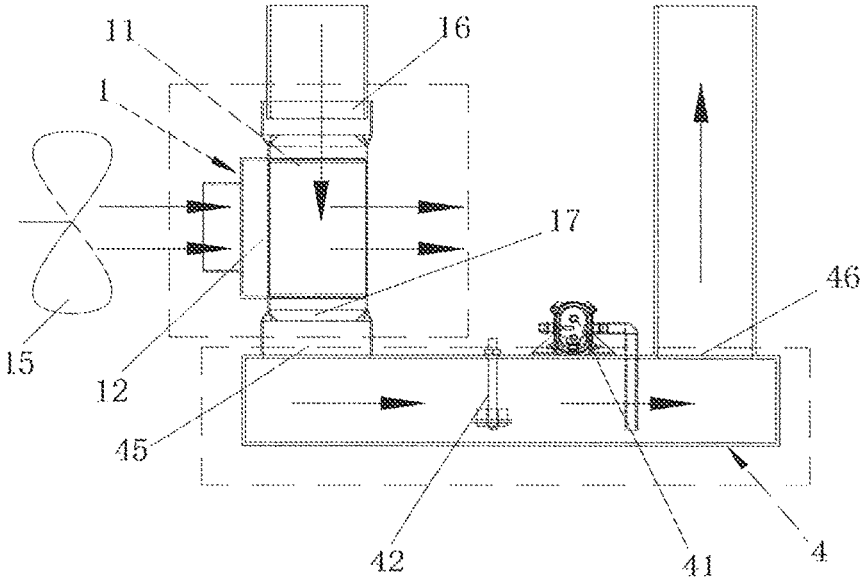
FIG. 6 is a schematic drawing of air channels of heat exchanger of Embodiment 3 of the invention.
Figure 7:
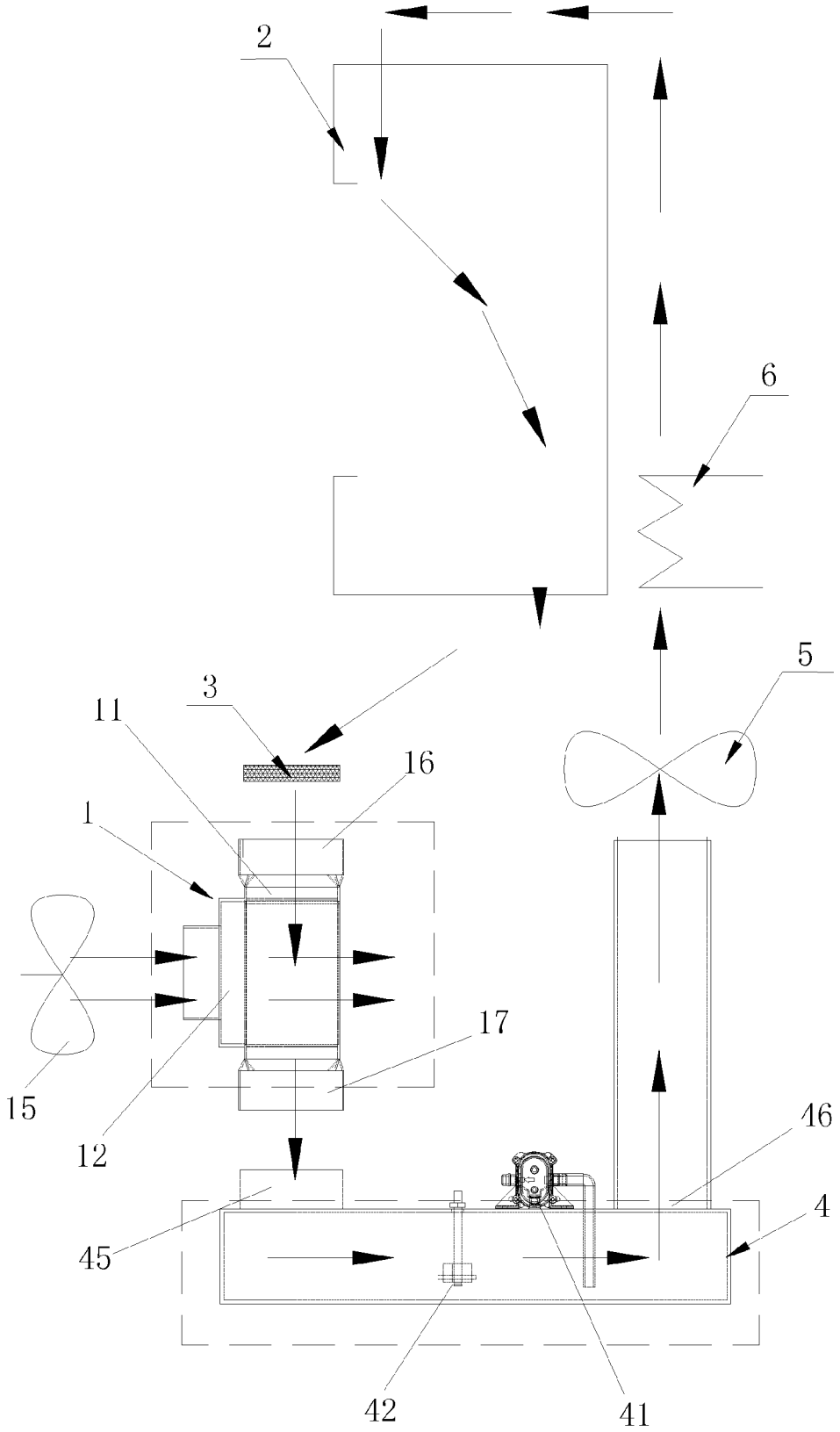
FIG. 7 is a schematic drawing of circular drying system of clothes dryer of Embodiment 3 of the invention.

As shown in FIG. 5-7, the foregoing heat exchanger may be installed inside a washing-drying integral machine (see FIG. 5) or a clothes dryer (see FIG. 7), which comprises a clothes tub 2, an air outlet 21, a filter 3, a heat exchanger 1, a water collection box 4, a drying fan 5, a heating unit 6 and an air inlet 22. The air outlet 21 communicates with the heat exchanger 1 which communicates with the water collection box 4; and the water collection box 4 communicates with the air inlet 22. The filter 3 is arranged between the air outlet 22 and the heat exchanger 1, and the drying fan 5 and the heating unit 6 are arranged between the water collection box 4 and air inlet 22 in turn. The water collection box 4 communicates with the outside through a draining pump 41, and a water level inductive switch 42 for controlling to turn on the draining pump 41 is installed in the water collection box 4. Specifically, the water collection box 4 comprises a water-holding box 43 and a top cover 44 (see FIGS. 3 and 4). An inlet 45 communicating with a hot and humid air outlet 17 of the condensing air channel of the heat exchanger and an outlet 46 communicating with the air inlet 22 of the clothes dryer are arranged on the top cover 44.

Wherein, the clothes tub 2, the air outlet 21, the filter 3, the drying fan 5, the heat unit 6 and the air inlet 22 all may adopt the designs in prior arts. The air inlet and the air outlet are both the air inlet and the air outlet of the clothes tub. The heating unit 6 is generally made of heating pipe or heater strip or heating plate. The filter 3 is composed of at least one layer of filter net, which is dismountable.

As shown in FIG. 7, in drying, the hot and humid air from the air outlet of the clothes tub 2 enters the condensing air channel 11 of the heat exchange 1 along the pipeline. In the heat exchanger, the external air passed in through the external air channel 12 of the heat exchanger 1 exchanges heat with the hot and humid air in the condensing air channel 11. Temperature of the hot and humid air in condensing air channel 11 drops while its relative humidity rises. Partial air around the wall of the air chambers gets saturated, and vapors in the air precipitate and flow into the water collection box 4 along with the wall of the air chambers. When the water level is monitored to reach the pre-set position by the water level inductive switch 42, the draining pump 41 is turned on, discharging the condensate water. The condensed low-heat and low-humidity air passes through the water collection box 4, and is sent to the heating unit 6 for heating by the drying fan 5, and then reflows into the clothes tub 2 through the air inlet.

Embodiment 4

Figure 8:
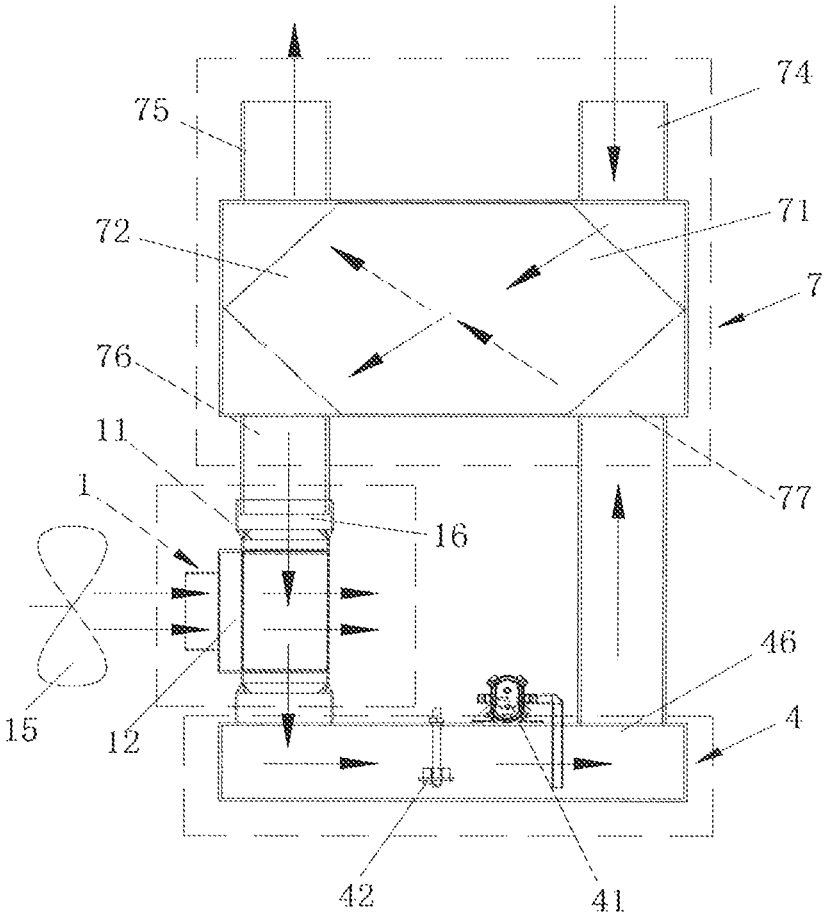
FIG. 8 is a schematic drawing of air channels of heat exchanger and residual heat recovery device of Embodiment 4 of the invention.
Figure 9:
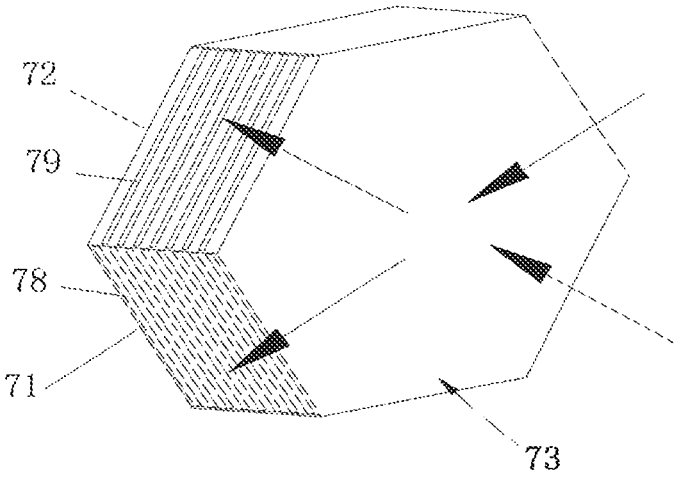
FIG. 9 is a structural schematic drawing of the heat exchanger and residual heat recovery device of Embodiment 4 of the invention.

As shown in FIGS. 8 and 9, the drying system of this embodiment consists of the heat exchanger 1 of Embodiment 1 or 2 and a residual heat recovery device 7. The interior of the residual heat recovery device 7 comprises two groups of air channels, namely, a hot and humid air channel 71 and a residual heat recovery air channel 72. The two groups of air channels form a heat exchange structure. The hot and humid air channel 71 communicates with the condensing air channel 11, the water collection box 4 and the residual heat recovery air channel 72 in turn through ventilating ducts.

Specifically, the residual heat recovery device 7 comprises a shell 70, and a heat exchanger 73 arranged inside the shell. The hot and humid air channel 71 and the residual heat recovery air channel 72 are arranged in the heat exchanger 73 in the way of bidirectional cross convection. Corresponding to two groups of air channels, an air inlet 74 of the hot and humid air channel and an air outlet 75 of the residual heat recovery air channel are arranged on the upper of the shell 70, and an air outlet 76 of the hot and humid air channel and an air inlet 77 of the residual heat recovery air channel are arranged on the lower of the shell 70. With respect to the air inlet 77 and the air outlet 75 of the residual heat recovery air channel 77, the air inlet 74 and the outlet 76 of the hot air and humid air channel all are arranged on the cross. The air outlet 76 of the hot and humid air channel of the residual heat recovery device 7 communicates with the air inlet 16 of the hot and humid air channel of the condensing air channel 11 of the heat exchanger 1, and the air inlet 77 of the residual heat recovery air channel communicates with the outlet 46 of the water collection box 4.

In the interior of the heat exchanger 73, two groups of heat exchange fins form the hot and humid air channel and the residual heat recovery air channel. Each group of the heat exchange fins form a plurality of air channels along the same direction. The space between the neighboring air channels of the same group is an air channel of the other group. The air channels composed of two groups of heat exchange fins are set by interval, which forms the heat exchange structure with bidirectional cross convection.

Alternatively, as shown in FIG. 9, the interior of the heat exchanger 73 is composed of multiple parallel plates. Air channels 78 and 79 are arranged between two adjacent plates. Two group of isolated and crossed air channels are formed by blocking the air channels at intervals along the inlet direction and the outlet direction. Alternatively, in an integral structure, penetrating two groups of two-way crossed air channels 78 and 79. Or the heat exchanger 73 can also adopt the existing plate-interval recuperative heat exchanger.

Embodiment 5

Figure 10:
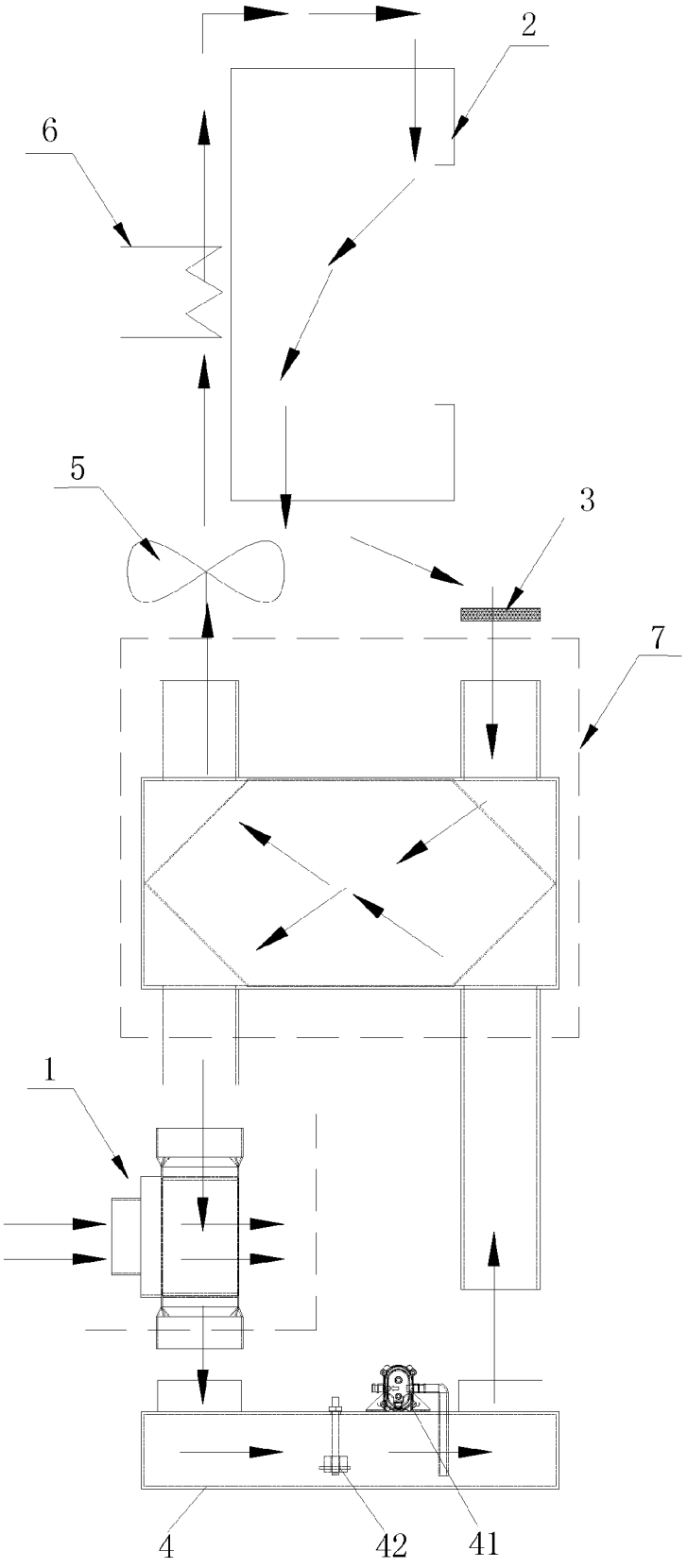
FIG. 10 is a schematic drawing of circular drying system of clothes dryer of Embodiment 5 of the invention.

As shown in FIG. 10, the difference from that of Embodiment 3 is that the clothes dryer or the washing-drying machine of the embodiment is arranged the residual heat recovery device 7 on the basis of Embodiment 4. The residual heat recovery device 7 is set between the filter 3 and the heat exchanger 1, also between the water collection box 4 and the drying fan 5. The hot and humid air channel 71 communicates with the filter 3 and the heat exchanger 1, and the residual heat recovery air channel 72 communicates with the water collection box 4 and the drying fan 5. The hot and humid air passes out from the air outlet of the clothes tub 2, and flows through the hot and humid air channel 71 of the residual heat recovery device 7, the heat exchanger 1 and the water collection box 4 successively, then flows through the residual heat recovery air channel 72 of the residual heat recovery device 7. Thus, it is completed to recover the residual heat.

Embodiment 6

As shown in FIG. 10, in drying, the hot and humid air from the air outlet of the clothes tub 2 goes in the hot and humid air channel 71 through the air inlet of the hot and humid air channel 74 of the residual heat recovery device, and is discharged from the air outlet 76 of the hot and humid air channel 76, and then enters the condensing air channel 11 of the heat exchanger 1. In the heat exchanger, the external air passed in through the external air channel 12 of the heat exchanger 1 exchanges heat with the hot and humid air in the condensing air channel 11. Temperature of the hot and humid air in condensing air channel 11 drops, while its relative humidity rises. Partial air around the wall of the air chambers gets saturated, and vapors in the air precipitate and flow into the water collection box 4 along with the wall of the air chambers. When the water level is monitored to reach the pre-set position by the water level inductive switch 42, the draining pump 41 is turned on, discharging the condensate water. The condensed low-heat and low-humidity air passes through the water collection box 4, and is sent to the air inlet 77 of the residual heat recovery air channel of the residual heat recovery device, and then goes in the residual heat recovery air channel 72. The temperature of the condensed air water decreases while water content decreases. So, The low temperature air getting back to the residual heat recovery device exchanges heat with the hot and humid air inside the hot and humid air channel 71 again. As a result, before going into the heat exchanger 1, the hot and humid air is cool in advance. The dry air through the residual heat recovery device 7 heats up before being heated inside the heating unit 6, thus it becomes preheated. Therefore, energy consumption on reheating the air in the drying recycle system is reduced, and the noise generated by condensing air in high flow rate is reduced.

Based on the above embodiments, to prevent lint blocking the heat exchanger 1 or the residual heat recovery device 7 and to better filter the lint, the filter 3 comprises at least two layers of filter net. And the layer next to the outlet is dismountable and convenient for flushing.

In this invention, the heat exchanger made of plastic film is adopted to air-cool the external air, which is efficient and easy to be processed, meanwhile, it is easier to be assembled and installed in accordance with the drying power of the clothes dryer or washing-drying integral machine. Besides, clothes dryer or washing-drying integral machine arranged with such heat exchanger is lighter, more coinvent and cost-saving in transportation.

Above embodiments are merely descriptions of the present invention other than limitations to its conception or scope. Any modification or alteration of the present invention within the scope of the present invention claims and equivalent replacement will be apparent to those skilled in the art without departing from the scope and spirit of the present invention.

The invention claimed is:

1. A heat exchanger for condensation in clothes drying, wherein:

the heat exchanger is an external air-cooled type heat exchanger, which comprises two groups of air channels oriented in different directions and not communicating with each other;

the groups of air channels are respectively a condensing air channel and an external air channel;

each group of air channels is composed of a plurality of air chambers;

the air chambers of the two groups of air channels are arranged alternately, and a space between each two neighboring air chambers of the condensing air channel is an air chamber of the external air channel;

a condensate fan is set on one end of the external air channel, and another end is communicated to the outside;

one end of the condensing air channel is a hot and humid air inlet, and another end of the condensing air channel is a condensed air outlet;

a mechanism for flushing lint is arranged at one end of the hot and humid air inlet of the condensing air channel of the heat exchanger; and the mechanism for flushing lint comprises a flushing valve connection communicating with the outside, a flushing passageway communicates with the flushing valve connection and is located within the hot and humid air inlet and annularly around the groups of air channels, and a flushing mouth is located along the inside edge of the flushing passageway, the flushing mouth being configured to flush water towards the air chambers of the condensing air channel.

2. The heat exchanger for condensation in clothes drying according to claim 1, wherein:

the external air channel is in a horizontal direction, and the condensing air channel is in a vertical direction.

3. The heat exchanger for condensation in clothes drying according to claim 1, wherein:

the heat exchanger is composed of plastic film with a thickness of 0.05 mm to 1.5 mm, and two neighboring air chambers are spaced by the plastic film.

4. The heat exchanger for condensation in clothes drying according to claim 3, wherein the thickness of the plastic film is in the range of 0.08 mm to 0.8 mm.

5. The heat exchanger for condensation in clothes drying according to claim 1, wherein a ventilation clearance of each air chamber of the heat exchanger is 1 mm to 20 mm.

6. The heat exchanger for condensation in clothes drying according to claim 5, wherein the ventilation clearance of the each air chamber is 3 mm to 12 mm.

7. A clothes dryer, comprising a clothes tub, an air outlet, a filter, a drying fan, a heating unit, a heat exchanger and an air inlet, wherein:

the clothes dryer also comprises a water collection box;

the air outlet communicates with the heat exchanger;

the heat exchanger communicates with the water collection box;

the water collection box communicates with the air inlet;

the filter is arranged between the air outlet and the heat exchanger;

the drying fan and the heating unit are arranged between the water collection box and the air inlet;

the heat exchanger is an external air-cooled type heat exchanger, which comprises two groups of air channels oriented in different directions and not communicating with each other;

the groups of air channels are respectively a condensing air channel and an external air channel;

each group of air channels is composed of a plurality of air chambers;

the air chambers of the two groups of air channels are arranged alternately, and a space between each two neighboring air chambers of the condensing air channel is an air chamber of the external air channel;

a condensate fan is set on one end of the external air channel, and another end is communicated to the outside;

one end of the condensing air channel is a hot and humid air inlet, and another end of the condensing air channel is a condensed air outlet;

a mechanism for flushing lint is arranged at one end of the hot and humid air inlet of the condensing air channel of the heat exchanger; and the mechanism for flushing lint comprises a flushing valve connection communicating with the outside, a flushing passageway communicates with the flushing valve connection and is located within the hot and humid air inlet and annularly around the groups of air channels, and a flushing mouth is located along the inside edge of the flushing passageway, the flushing mouth being configured to flush water towards the air chambers of the condensing air channel.

8. The clothes dryer according to claim 7, wherein:

the filter is composed of at least one layer of filter net, and at least one layer of filter net is dismountable.

9. The clothes dryer according to claim 7, wherein:

the water collection box communicates with the outside via a draining pump, and a water level inductive switch for controlling to turn on and off the draining pump is installed in the water collection box.

10. The clothes dryer according to claim 7, wherein:

the clothes dryer also comprises a residual heat recovery device arranged between the filter and the heat exchanger, the residual heat recovery device comprising a hot and humid air channel and a residual heat recovery air channel arranged in the residual heat recovery device to form a heat exchange structure, wherein the hot and humid air channel communicates, by a ventilating duct, with the following features in the following order: (1) the condensing air channel of the heat exchanger; (2) the water collection box; and (3) the residual heat recovery air channel.

11. The clothes dryer according to claim 10, wherein:

the water collection box comprises a box body and a top cover, the top cover is provided with an inlet communicating with the condensing air channel of the heat exchanger and an outlet communicating with the residual heat recovery air channel of the residual heat recovery device, a draining pump is installed in the water collection box, and a water level inductive switch for controlling to turn on and off the draining pump is installed in the water collection box.

12. The clothes dryer according to claim 10, wherein:

the residual heat recovery device further comprises a shell and the heat exchange structure arranged inside the shell, the hot and humid air channel and the residual heat recovery air channel are arranged in the shell for bidirectional cross convection, and an inlet of the hot and humid air channel and an outlet of the residual heat recovery air channel are arranged at an upper portion of the shell, and an outlet of the hot and humid air channel and an inlet of the residual heat recovery air channel are arranged at a lower portion of the shell.

13. The clothes dryer according to claim 12, wherein:

the hot and humid air channel is one of a plurality of hot and humid air channels and the residual heat recovery air channel is one of a plurality of residual heat recovery air channels, the heat exchange structure is composed of two groups of heat exchange fins, each group of heat exchange fins forms a plurality of air channels in a same direction, and spaces between the heat exchange fins form the hot and humid air channels and the residual heat recovery air channels to allow for bidirectional cross convection.

14. A clothes drying method, comprising:

during drying, (i) running hot and humid air through a hot and humid air channel of a residual heat recovery device for preliminarily exchanging heat with a residual recovery air channel, the hot and humid air having been obtained by heat exchange of hot air in a clothes tub with clothes, and (ii) running the hot and humid air through a heat exchanger to condense moisture from the hot and humid air and collecting the moisture inside and a water collection box, whereby dry air is obtained;

then preheating the dry air in the residual heat recovery air channel by exchanging heat with the hot and humid air channel of the residual heat recovery device; and then heating a preliminarily preheated dry air via a heating unit to obtain heated dry air, and directing the heated dry air to the clothes tub to exchange heat with the clothes in the clothes tub, wherein the method further comprises flushing lint using a mechanism for flushing lint, wherein:

the heat exchanger is an external air-cooled type heat exchanger, which comprises two groups of air channels oriented in different directions and not communicating with each other;

the groups of air channels are respectively a condensing air channel and an external air channel;

each group of air channels is composed of a plurality of air chambers;

the air chambers of the two groups of air channels are arranged alternately, and a space between each two neighboring air chambers of the condensing air channel is an air chamber of the external air channel;

a condensate fan is set on one end of the external air channel, and another end is communicated to outside;

one end of the condensing air channel is a hot and humid air inlet, and another end of the condensing air channel is a condensed air outlet;

the mechanism for flushing lint is arranged at one end of the hot and humid air inlet of the condensing air channel of the heat exchanger; and the mechanism for flushing lint comprises a flushing valve connection communicating with the outside, a flushing passageway communicates with the flushing valve connection and is located within the hot and humid air inlet and annularly around the groups of air channels, and a flushing mouth is located along the inside edge of the flushing passageway, the flushing mouth being configured to flush water towards the air chambers of the condensing air channel.

* * * * *